US006110044A

United States Patent [19]

Stern

[11] Patent Number: 6,110,044

[45] Date of Patent: Aug. 29, 2000

[54] METHOD AND APPARATUS FOR ISSUING AND AUTOMATICALLY VALIDATING GAMING MACHINE PAYOUT TICKETS

[76] Inventor: Richard H. Stern, 5113 Yuma Pl., NW., Washington, D.C. 20016-4309

[21] Appl. No.: 08/892,980

[22] Filed: Jul. 15, 1997

[51] Int. Cl.[7] ..... A63F 9/22

[52] U.S. Cl. ..... 463/29; 463/16; 273/269

[58] Field of Search ..... 463/16–20, 29; 235/375; 273/139, 269

[56] References Cited

U.S. PATENT DOCUMENTS

| | | | |
|---|---|---|---|
| 4,373,726 | 2/1983 | Churchill et al. | 463/29 |
| 4,882,473 | 11/1989 | Bergeron et al. | 463/17 |
| 5,054,787 | 10/1991 | Richardson | 463/19 |
| 5,083,272 | 1/1992 | Walker et al. | 463/19 |
| 5,091,634 | 2/1992 | Finch et al. | 235/375 |
| 5,112,050 | 5/1992 | Koza et al. | 463/17 |
| 5,260,552 | 11/1993 | Colbert et al. | 235/482 |
| 5,317,135 | 5/1994 | Finocchio | 235/375 |
| 5,499,816 | 3/1996 | Levy | 463/17 |
| 5,505,449 | 4/1996 | Eberhardt et al. | 463/17 |
| 5,507,491 | 4/1996 | Gatto et al. | 463/17 |

FOREIGN PATENT DOCUMENTS

| | | |
|---|---|---|
| 9609098 | 3/1996 | WIPO . |

*Primary Examiner*—Michael O'Neill
*Attorney, Agent, or Firm*—Richard H. Stern

[57] ABSTRACT

A method and apparatus for enhancing security in issuing and redeeming gaming tickets is described in which a machine-readable indicium (preferably barcoding) is embodied in a payout ticket from a gaming machine. When the ticket is presented for redemption, the machine-readable indicium is read automatically (preferably by a barcode reader), to provide electronic signals which are then processed electronically to determine whether the ticket is genuine (valid). In a preferred embodiment, a barcode reader reads from a ticket a validation number which if genuine is a predetermined function of a payout amount and one or more other parameters barcoded on the ticket; an electronic processing unit then determines whether the barcoded data is related according to the predetermined function.

20 Claims, 3 Drawing Sheets

METHOD AND APPARATUS FOR ISSUING AND AUTOMATICALLY VALIDATING GAMING MACHINE PAYOUT TICKETS

BACKGROUND

The invention relates to the issuance and validation of gaming machine payout tickets containing a validation number, where the purpose of the validation number is to prevent or hinder counterfeiting of the tickets.

Since Congress passed the Indian Gaming Regulatory Act of 1988 (IGRA), there has been a substantial increase in the number of small gaming establishments operated by or under the regulation of Indian Nations or in Indian lands. Some of these establishments are large operations, comparable to casinos located in Las Vegas. Many of these establishments, however, are small operations without the elaborate and expensive computer and telecommunications equipment often found in large casinos. These small casino operations have a need for security and bookkeeping procedures, but are unable to provide such functions by means of elaborate and expensive computer and telecommunications equipment. Rather, they require inexpensive and uncomplicated means for providing these functions. In particular, they have a need for inexpensive and uncomplicated means for preventing counterfeiting scams in payout for video poker and video slot games, as well as similar gaming products popular in small casinos.

Payout tickets bearing validation numbers have been widely used to aid in providing security and audit functions in payout for video poker and video slot games, as well as similar gaming equipment popular in small casinos. Payout tickets have been small sheets of paper, similar in dimensions to cash register receipts used in supermarkets and other retail stores. Such payout tickets may contain the following, among other, information imprinted on them: name of establishment, identification number of gaming machine and/or floor location identification number of gaming machine, date and time of ticket issuance (i.e., date and time of occurrence of payout event in gaming unit), cash amount to be paid (payout amount), ticket serial number, and a "validation number" (explained below). The data printed on the ticket is generated by electronic circuitry on a printed circuit board controlling play of the gaming machine or by an auxiliary printed circuit board. After the ticket is printed within a gaming machine, the ticket is dispensed or provided to the customer by conventional means, such as dropping it into a delivery chute when its printing is completed. The customer then takes the ticket to a cashier station for cash redemption and the cashier (if he or she follows instructions) tests the ticket for validity before making payment.

Such payout tickets have been widely used in gaming equipment operated under various state and provincial regulatory programs. Some of these regulations have required payments to winners of games to be made, in the first instance, not in cash (as in a machine that dispenses winnings in coins via a hopper) but instead by printed payout tickets which are then cashed in at cashier locations. Such regulations facilitate requiring the payees to present identification for subsequent assessment of state and federal taxes, and hinder schemes to tamper with the equipment. They also facilitate controlling payouts and prevention of certain schemes for skimming proceeds. Alphanumeric ticket printers used for this purpose in gaming machines have included the NCR Corp. printer models 2567 (using RS-232C interface) and 2191/2192 (using proprietary TTL interface).

A validation number for a gaming machine payout ticket is a control number, ordinarily generated in a programmed microprocessor chip by a scheme, protocol, or algorithm, in order to prevent successful counterfeiting of payout tickets and redemption of bogus tickets. Unless the validation number printed on the ticket is correct, no payment is made.

Various different validation expedients have been used in the gaming industry. A validation number V can be a function $V=F(u_1, u_2 \ldots u_n)$, where the parameters $U_1, U_2 \ldots u_n$ are one or more such parameters as the time, date, machine-identification number, payout amount, and ticket serial number. Depending on the function F, the validation number V so developed can be inversely processed to yield the payout amount, and that figure can be checked against the payout amount printed on the ticket to determine if they are the same. Thus, a payout amount p, may be represented as G(V), where G has an inverse relationship to F such that $G=F^{-1}$. (Purely hypothetically, F could be log, so that V=log p. G would then be antilog $[\log^{-1}]$, so that $p=\log^{-1} V$. Or F could be square and G would then be square root.) For functions permitting this operation, p can be determined by using a microprocessor chip to perform appropriate operations on validation number V. The ticket passes the security test if the value of p so computed is the same as that printed on the payout ticket. Other expedients termed "encryption" systems are also used in the gaming industry, in which the term is used to designate a variety of ways to disguise and protect a ticket validation system against counterfeiting.

A player (customer) ordinarily collects his or her winnings by presenting a payout ticket to a cashier. The cashier may enter various numbers printed on the ticket into a personal computer by keypunching in accordance with predetermined instructions, so that the computer can perform validation computations based on the keypunched numbers. A problem with the foregoing currently used method of validating tickets is that the keypunching by the cashier, so that a computer can do the necessary processing, is time-consuming and tedious, and data entry errors by the cashier may occur. (It has been estimated that manual data entry using a keyboard produces one incorrect character entry for every 300 keystrokes, and that it takes a person entering such data approximately six seconds to enter 12 characters.) Moreover, when cashiers in a casino are busy they may simply not check the validation numbers at all before redeeming the payout amount printed on the ticket.

A further problem with currently used ticket procedures is that state or provincial regulatory requirements or good accounting practices often require daily auditing of tickets. It is often required by regulation that tickets be printed in duplicate, one copy going to the customer and the other copy being retained inside the game machine. The retained copies of tickets are then checked by examining them and recording each entry. This is a time-consuming and error-prone procedure.

A summary of apparatus art that is here adapted for utilization in the invention may be found in Hayman U.S. Pat. No. 4,204,636 ("Interface between data reading wand and cash register display").

SUMMARY OF INVENTION

An object of this invention is to avoid shortcomings of time-consuming and error-prone redemption procedures now used, by providing a means to automatically ascertain whether a particular ticket is genuine (valid), simply by presenting the ticket to a machine, causing the machine to read data from the ticket, and having the machine provide a cashier with a GO/NO-GO signal. A further object of the invention is to provide an automatic means for making audit information available from machine-retained ticket copies of payout slips. A further object of the invention is to accomplish these purposes with inexpensive, uncomplicated equipment that is compatible with the kind of equipment used in small casinos and with the working conditions prevalent in such establishments.

A gaming machine, such as a video poker, video slot, or video pull-tab game, utilizing the invention contains a barcode printer (or other means for embodying a machine-readable indicium in a payout ticket), which prints both alphanumeric and barcode information on a payout ticket, including a validation number. The particular information barcoded onto the ticket depends on the ticket validation method to be used. The ticket is then dispensed to a customer.

The invention automatically validates tickets by permitting the cashier to present the ticket to a machine, which then indicates whether the ticket is genuine. The payout ticket has been printed with barcode data. The barcode data on the ticket includes the validation number and the information from which the validation number encryption algorithm determined the validation number at the time that the ticket was printed.

In one embodiment, a stand-alone validation system includes a barcode reader and electronic processing equipment. The system reads barcode data representative of various payout-event-related parameters, converts the barcode data to a computer-readable signal, determines what the validation number should be by repeating the validation number determination procedure with the same algorithm, compares the result with the barcoded validation number on the ticket, and determines whether they are the same. (A simpler, but non-preferred, embodiment places only the validation number in barcode format on the ticket and the barcode reader reads off the validation number, and compares it against a memory to determine whether it is a "permitted" number.) Another embodiment provides a barcode reader that interfaces with a personal computer already in use at the cashier station, to provide functions similar to those just described.

An embodiment of the invention assures that all requisite auditing data is barcoded both on the ticket and on a duplicate copy of it retained inside the game machine. This permits automated recordation of audit data from the retained tickets, thereby reducing labor and error in auditing such data.

DETAILED DESCRIPTION OF INVENTION

Overview

Figure 1:
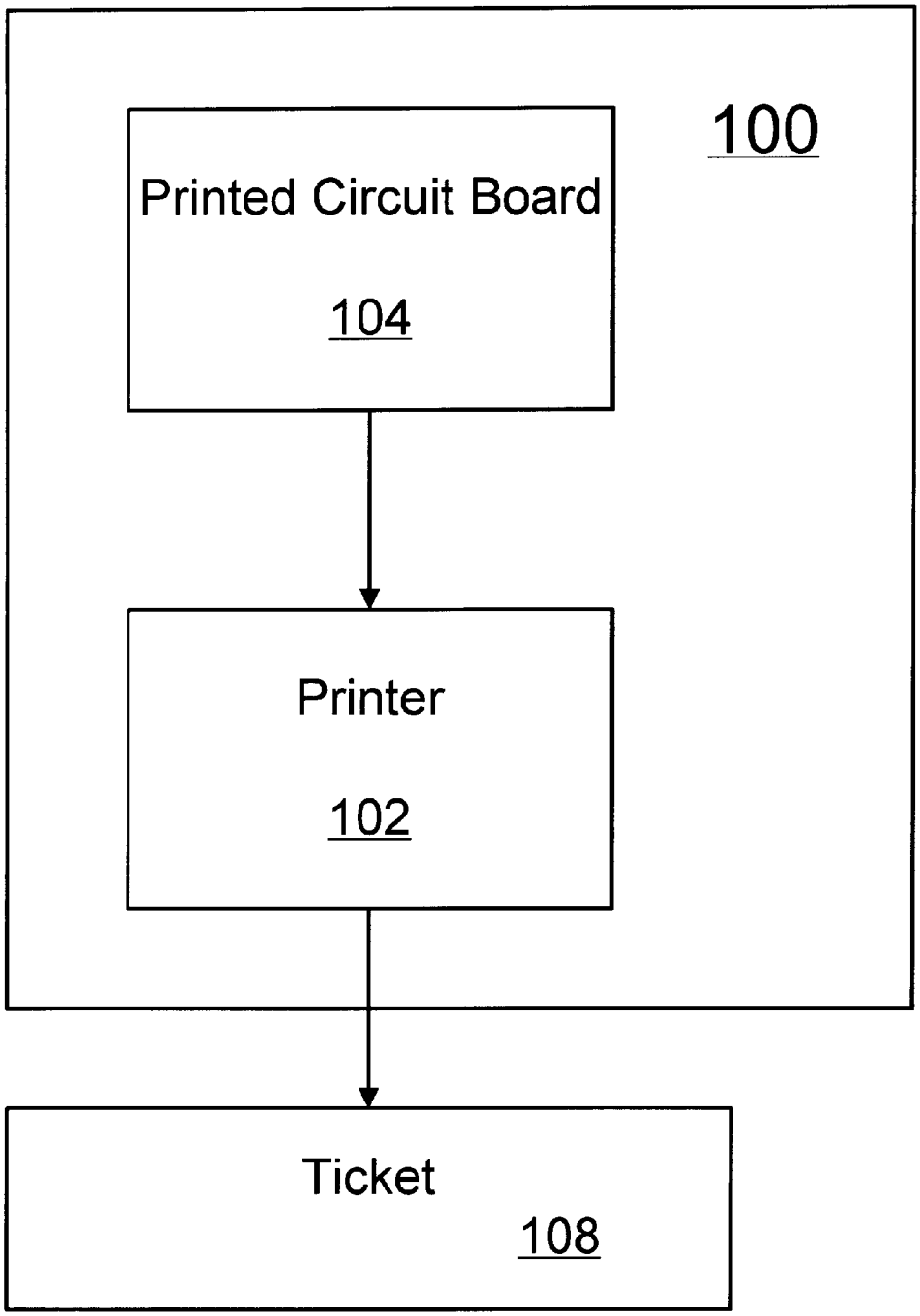
FIG. 1 is a block diagram of a gaming cabinet in accordance with the invention.

The system of the invention, considered as a whole, has two main components which ordinarily are of necessity separate. One main component, shown in FIG. 1, is a gaming cabinet 100 located in a gaming casino along with other gaming cabinets. The cabinet contains gaming machinery and equipment for issuing a payout ticket 106 (FIG. 2) on occurrence of a payout event. Payout ticket 106 is provided to a customer who successfully played (won) the game. The customer then ordinarily takes the ticket to a cashier station in the casino and there presents the ticket for redemption. The cashier uses the other main component of the invention, a validation unit 200, shown in FIG. 3, to check the ticket for genuineness. Upon validation unit 200's validating the ticket as genuine, the cashier pays the customer the payout amount shown on the ticket, which is also displayed on the computer screen.

It is contemplated that the electronic circuitry described below will be implemented by means of a programmed microprocessor or microcontroller chip (such as a Z80 or Z180) or other programmed computer (for example, a commercial PC in the case of unit 200), but persons skilled in design of electronic equipment will appreciate that some of the circuitry described below can be implemented alternatively by use of a gate array, FPLD (field-programmable logic device), or comparable hardware.

Ticket Issuance

Figure 2:
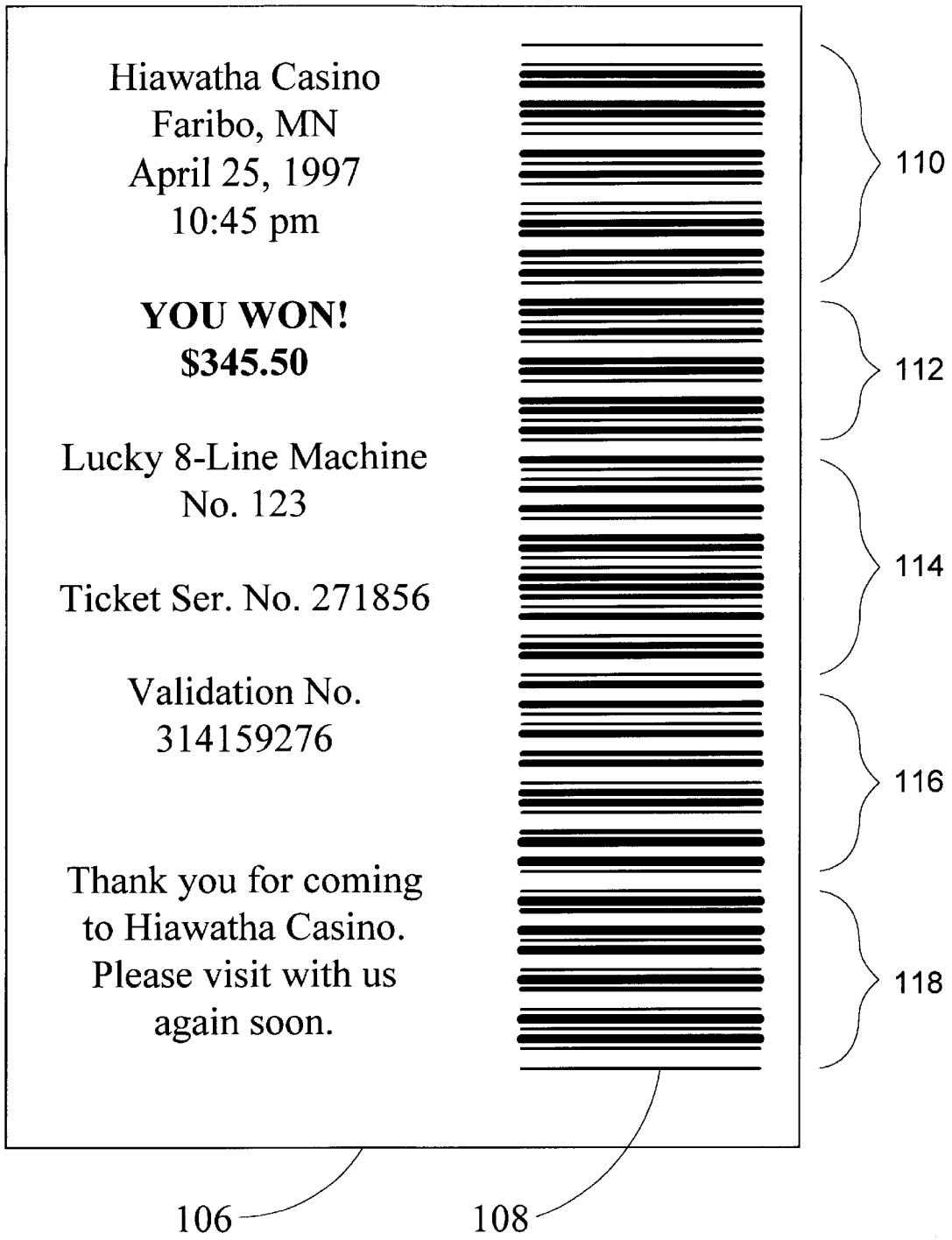
FIG. 2 is a plan view of a payout ticket according to the invention.

Referring to FIG. 1, showing a game cabinet 100 according to the invention, it is seen that cabinet 100 contains various components of an electronically operated gaming machine, such as a video poker, video slot, or video pull-tab machine. Cabinet 100 contains an impact printer 102, for printing alphanumeric symbols and for encoding barcode symbols on a payout ticket 106 (FIG. 2).

Cabinet 100 also contains a printed circuit board 104 which includes, among other things, a processor (e.g., a Z80 microprocessor chip or Z180 microcontroller chip) and memory (e.g., EPROMs). Printed circuit board 104 controls operation of a game (which may be, for example, a video slot game such as the "Lucky 8-Line" game of Octalinear Systems, Inc.). Printed circuit board 104 sends signals to printer 102 for printing alphanumeric symbols on payout ticket 106, upon occurrence of a payout event. Internal circuitry within printed circuit board 104 selects signals from those within the memory of, and generated by game playing circuitry of, printed circuit board 104, for conversion into alphanumeric symbols (imprint data) to be printed on ticket 106. These signals are representative of such data as the name of the casino, the time and date of the payout event, the payout amount that the player won, a number identifying the particular gaming machine, a ticket serial number, and a validation number.

Cabinet 100 further contains selection circuitry 105 for selecting some of the foregoing types of imprint data for barcoding on (or other embodiment on or in) payout ticket 106, in accordance with the present invention. Which imprint data is selected by circuitry 105 for embodiment in barcode depends on the validation system to be used (as described below). Selection circuitry 105 may also contain circuitry for encrypting all or part of the barcoded data imprinted on the payout ticket. However, it is optional whether to encrypt any of the barcoded data. Instead, the barcoded data (embodiment data) can all be presented in non-encrypted (i.e., plain) format. The encrypted data, if any, is utilized for security purposes as described below, to foil counterfeiting.

Selection circuitry 105 may be implemented as part of printed circuit board 104, in the case of a new printed circuit board. In the case of an existing printed circuit board which is to be retrofitted, a separate printed circuit board may be made for containing circuitry 105 of the invention.

As indicated above, printed circuit board 104 contains electronic circuitry for selecting a predetermined set of payout-event-related signals and feeding them to a printer (or its interface), so that they can be printed on the payout ticket. As shown in FIG. 1, such circuitry in printed circuit board 104 feeds these signals to printer 102, which operates in response to the signals to print alphanumeric symbols on the ticket, as shown at the left part of the ticket of FIG. 2. (A commercial unit such as one of the NCR models mentioned in the Background, contains built-in interface circuitry at its input for receiving signals from a printed circuit board and for processing them to derive signals that drive the printer's mechanism to cause appropriate alphanumeric symbols to be printed. It is therefore unnecessary to provide printer interface circuitry within printed circuit board 104, for such units.)

Similarly, some or all such selected payout-event-related signals from printed circuit board 104 are selected in circuitry 105 for use to generate barcode for printing on the ticket. Dot-matrix and thermal printers already exist that can print information in both alphanumeric symbols and barcode format (for example, Magnatek, Inc., Bloomfield, Conn., Model 4300 dot-matrix printer, using RS 232 input interface).

Dot-matrix or other impact printers are considered preferable in this application because they readily permit multiple copies of the ticket to be made, as regulatory laws frequently demand. However, thermal printers produce better quality and more readable barcode data. It is possible to have a separate alphanumeric printer and barcode printer, but it is considered more economical and convenient to combine alphanumeric printing and barcode printing in a single unit. (However, if a machine-readable indicium of a type different from barcode is used, such as a magnetic strip of the type found in Metro fare cards, it could be necessary to have two separate units: (a) an alphanumeric printer and (b) an indicium encoder or imprinter. In the following discussion the implementation described has a unit of the Magnatek Model 4300 type—i.e., single printer unit for both alphanumeric and barcode symbols. In the claims the term "encoder" is used to refer to any device for imprinting a machine-readable indicium in or on a payout ticket, including the barcode printer portion of a dual-function printer such as a Magnatek Model 4300.)

Ticket

Ticket 106, shown in FIG. 2, contains the type of alphanumeric information that payout tickets ordinarily contain. In addition, ticket 106 contains barcode data 108 in accordance with the present invention. The barcode data can be printed in any of several barcode formats. UPC (universal product code) format is considered desirable here because a great deal of equipment is available in the marketplace for this format, retail trade having standardized on UPC format. However, it is generally considered that Code 39 format, which is widely used in the automotive industry and in military applications, provides highest data security. Printers also exist for printing machine-readable symbols in another optically readable format, such as OCR alphanumeric format; but barcode format is considered preferable. (It is also possible to utilize other expedients for providing a machine-readable indicium of data, such as using magnetic strips of the type used in Metro fare cards.)

Accordingly, ticket 106 is printed with both barcode and alphanumeric information. Barcode data 108 comprises several fields of information. These fields of barcode information may advantageously include a payout amount field 110, a time-date field 112, a machine identification field 114, a ticket serial number field 116, and a validation number field 118. At a minimum, barcode data 108 should comprise validation number field 118. It is highly desirable, also, that barcode data 108 should additionally comprise payout amount field 110. It is preferred that barcode data 108 should additionally comprise one or more of time-date field 112, machine identification field 114, and ticket serial number field 116. (The reasons for this are given in the following section.)

Ticket Validation and Redemption

After ticket 106 is dispensed, the customer takes ticket 106 to a cashier, as at present, for purposes of redeeming it and collecting the payout amount.

Figure 3:
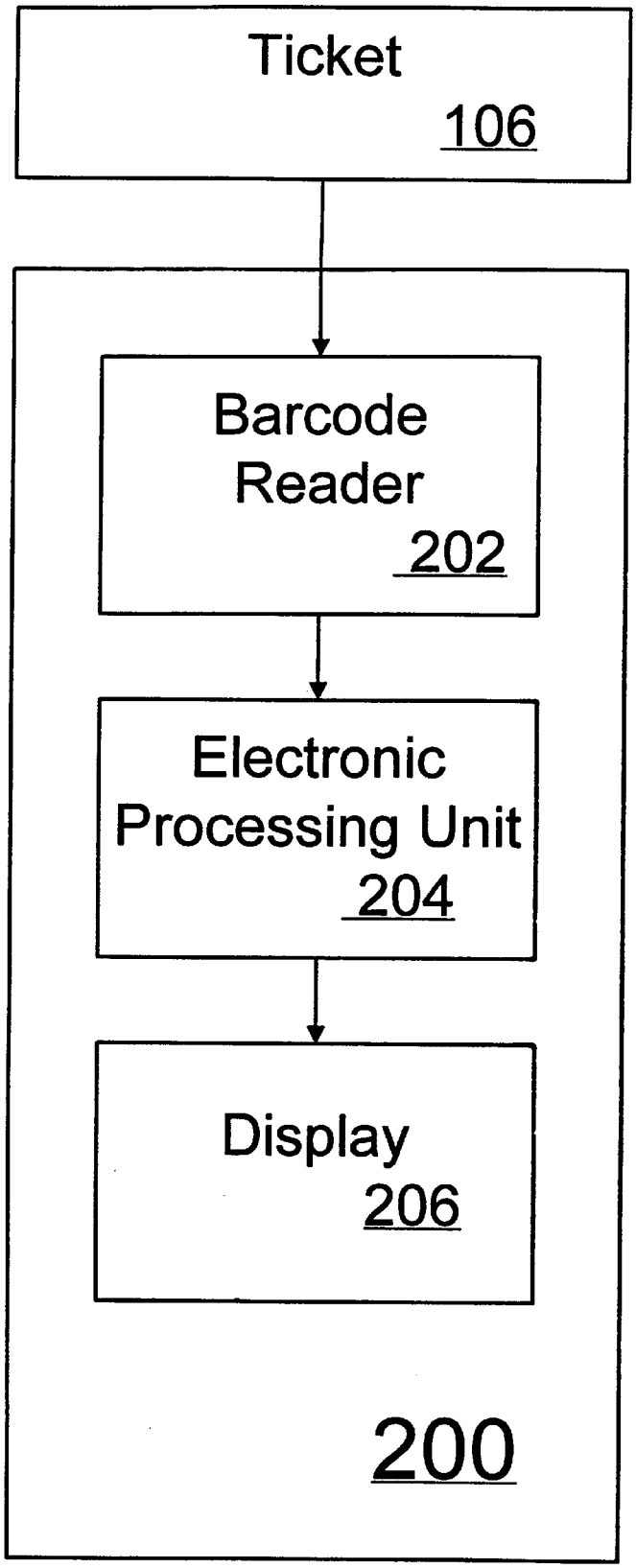
FIG. 3 is a block diagram of a validation unit according to the invention.

Referring to FIG. 3, after the customer presents ticket 106 to the cashier, the cashier presents ticket 106 to a validation unit 200. Validation unit 200 contains an optical reader (barcode reader) 202, of the type used in cash registers. (If a different type of machine-readable indicium is used, such as a magnetic strip, a reader appropriate for such indicia is used.) Reader 202 reads barcode data 108 printed on ticket 106, to provide a data signal representative of the ticket data that the barcode represents and that is embodied in the barcode (or other machine-readable indicium). The readout signal from the optical reader part of a commercial barcode reader is often converted into ASCII format by a keyboard wedge circuit included within the barcode reader. This ASCII signal corresponds to the data signal referred to above. If a barcode reader is used without a built-in wedge, such electronic circuitry must be supplied as part of unit 200; it is therefore preferable to use a barcode reader with a built-in wedge.

An electronic processing unit 204 receives the data signal and processes it for validation purposes. Electronic processing unit 204 is programmed to carry out the inverse of the procedure used in gaming cabinet 100 to determine the validation number, or else electronic processing unit 204 carries out a functionally equivalent operation. That is, electronic processing unit 204 in various embodiments performs operations that reverse the process used to develop the validation number, for the purpose of automatically determining whether the presented ticket is genuine. A display 206 then shows whether the ticket is genuine, operating in response to the foregoing determination.

Single Barcoded Field.

In its simplest embodiment, the security system uses merely a barcoded validation number (field 118 of the barcoding shown in FIG. 2). The physical information on the ticket is converted by a barcode wedge or equivalent circuitry into a data signal, as indicated above, without more. Under this system, the validation number is a many-digit validation number. A relatively small predetermined subset of such many-digit numbers belongs to a "permitted" subset of allowed validation numbers; the remaining, large majority of possible such many-digit numbers belong to a "non-permitted" subset. The subset of permitted numbers may be generated in electronic circuitry of printed circuit board 104 of gaming cabinet 100 by an algorithm or the subset may be chosen arbitrarily and stored in a look-up ROM in the circuitry of printed circuit board 104. The permitted subset is changed from time to time to hinder reverse engineering by counterfeiters.

The method of validation is to read the validation number barcoded on the payout ticket, and electronic processing unit 204 then compares it with the contents of a validation number source for the permitted subset of validation numbers. This is done either by using the algorithm to generate the predetermined subset (in which case a programmed microprocessor is the validation number source) or by reading the subset from a look-up ROM (or other memory, which acts as the validation number source). The validation number barcoded on the ticket is compared with the set of permitted validation numbers. If the barcoded validation number is a permitted one, the ticket is validated and the cashier pays the customer the payout amount printed on the ticket. This is not a preferred embodiment, but it corresponds to security measures that some establishments now use, the major difference being that here the validation number is machine-read instead of having to be keypunched by the cashier, reducing error and increasing speed of redemption.

Barcoded Payout Amount and Validation Number.

In a second embodiment, the payout amount is also barcoded on the ticket, so that the amount the cashier is to pay the customer can be machine-read and displayed on a computer screen or on an LED or LCD diode array 206. This embodiment permits some degree of further security to be provided, in that the payout amount and validation number can be made to have a predetermined relationship. (For example, purely hypothetically, the first three digits of the validation number are the last three digits of the square of the payout amount. More generally, V=F(p), where V is the validation number, p is the payout amount, and F is a predetermined function.) Since barcode reader 202 now reads both validation number field 118 and payout amount field 110 of the ticket of FIG. 2, the data signal is representative of both of these numbers. Therefore, electronic processing unit 204 can make the necessary computation (for example, that of the hypothetical example) and then make a comparison to test for counterfeiting (i.e., is it true that the barcoded values of V and p are such that V=F(p)?). This approach is somewhat more desirable than that of the previous paragraph, since it is harder to counterfeit successfully.

Three or More Barcoded Fields.

In a third and more preferable embodiment, one or more of time-date field 112, machine identification field 114, and ticket serial number field 116 are also included in barcode data 108. Therefore, the validation number can be determined as a function of those parameters (and also of the payout amount of field 110) when the ticket is issued. Then, when the ticket is presented for redemption, electronic processing unit 204 can make appropriate calculations to determine whether the purported payout amount is genuine.

For example, consider a system in which cabinet 100 provides a payout ticket 106 which has been barcoded with a validation number V, a payout amount p, and one or more additional parameters—such as a time and/or date of ticket issuance, a machine-identification number, and a ticket serial number—which for simplicity may be collectively represented as u. In this system, V=F (p,u). For example, purely notionally, $V=2p^2+3p+4u^2+5u+6pu+7$. The player (customer) wins the game and cabinet 100 issues to the player a ticket 106 with barcoding on it representative of payout amount p, of additional parameter u, and of validation number V determined according to the foregoing formula.

The player now takes ticket 106 to a cashier for redemption (i.e., to be paid $p.) Or a scam artist takes a bogus ticket to the cashier for redemption. The ticket has on it both printing and barcoding showing a putative payout amount p', a putative additional parameter u', and a putative validation number V'. The term "putative" is used here because the cashier does not know, a priori, whether the ticket is genuine or bogus. That is now to be determined.

The cashier presents the ticket to the barcode reader, which provides a readout signal representative of p', u', and V'. Electronic processing unit 204 now uses the barcode-derived signal to generate a signal representative of the result of performing the computation F(p',u'). This is what the validation number would be if computed from the putative data on the ticket (presumably the counterfeiters do not know what F is). Electronic processing unit 204 now compares this computed value with the portion of the readout signal representative of the barcoded validation number, which is the putative value V'. If they are equal, so that F(p',u')=V', the ticket is considered genuine. If not, it is bogus.

Under this system, the validation number can be made a function of many payout-event-related parameters, making it difficult for counterfeiters to reverse engineer the validation number procedure before the casino periodically changes it. The difficulty and error opportunity that is provided by requiring a human cashier to keypunch many parameter values into the validation system is eliminated, because the barcode reader does not care how many barcode fields it has to read (and of course the computer does not care how many variables it has to manipulate to determine V) and it is not susceptible to human error.

The foregoing hypothetical example did not use a validation number determination procedure with a practicable inverse (such as square and square root functions for a single variable). The invention can be practiced with such validation expedients (or any predetermined relationship among encoded machine-readable parameters), but they are not preferred, because it is considered easier to devise a validation procedure that is hard to reverse engineer when the validation procedure lacks a practicable inverse.

In further embodiments, some or all of the barcoded data is also encrypted according to a further encryption scheme (separate from that of calculating the validation number). In these embodiments, an electronic processing unit decrypts these barcoded parameters from the signal read out from the barcode before determining whether barcoded validation number V is the known function F of the other barcoded parameters (or has a given predetermined relationship with them). This approach may be characterized as first encrypting some of the payout-event-related data (for example, the validation number and payout amount) before barcoding it, so that the barcoded information is encrypted, and printing the ticket; second, decoding the barcode data signal into a decoded form; third, comparing the decoded data with a reference (such as using one of the validation schemes described above, for example, determining whether F(p')=V'), and then using the result of this determination to ascertain whether the ticket is genuine.

Time/Date Window Security Refinement

Additional refinements of the system are considered desirable to increase security. It is possible that a counterfeit ticket might be presented to the cashier, where the ticket carries barcode data copied from a previous genuine ticket of earlier date. In such a case, the human-readable alphanumeric symbols on the ticket might be those of the date on which the ticket is presented to the cashier, while the barcode data is that of an earlier date. If the system considered only the barcode data and nothing else, it would pass such a bogus ticket as genuine.

To prevent that, expedients should be used such as having the validation unit at the cashier station take the date from a source (clock/calendar module) within the cashier station unit, rather than merely from the ticket. The barcoded time and date can also be compared with that of the source, to ascertain whether the barcoded time and date fall within an appropriate window relative to that of the date read at the source. Typically, the appropriate window is defined by the business hours of the establishment during any particular continuous time segment. For example, if the establishment opens at 6 p.m. and remains open for 7 hours until 1 a.m., a ticket issued during that period must be cashed in during the same period, before 1 a.m. and not on a following evening. PCs typically already contain time/date modules (or cards). For stand-alone units, commercial clock/calendar modules are readily available.

Another security refinement is preventing presentation of one or more counterfeited exact duplicates of a genuine winning ticket, as well as the genuine original. The automatic validator machine should detect whether a ticket with the same ticket serial number from the same machine has previously been presented. (If the machine identification number or the ticket serial number is altered, the encrypted validation number will not be found correct on testing it for validity.) To accomplish this, a record is stored in a memory, containing historical data relating to past ticket redemptions over an appropriate period of time. The historical data may be ticket serial numbers and/or other data unique to a given payout event and thus unique to a given payout ticket (time, date, floor location of machine, etc.).

Stand-Alone System

Unit 204 can be a low-end computer or equivalent device, since only limited processing capacity is required. All that is needed is a printed circuit board with some program memory (such as EPROM) for the validation number algorithm, an arithmetic logic unit (ALU) to calculate, and some random-access memory (DRAM) as scratch-pad memory. In a contemplated stand-alone commercial embodiment of validation unit 200, the validation number algorithm (and any further encryption algorithm) is stored in an EPROM in a form not readily extracted (because of a setable security bit in the EPROM), and a Z180 microcontroller chip with UARTs provides an ALU with internal scratch-pad memory. One UART of the Z180 is used to interface to the barcode reader. A second UART is used to interface with other equipment or provide a security alert if a counterfeit ticket is detected.

In the event that more than one validation number encryption algorithm is in use at a given time, for example, for several different manufacturers' games, the encryption algorithm or procedure for a given gaming machine is designated for use in decrypting that machine's tickets. This is conveniently accomplished automatically by recording, in a memory of electronic processing unit 204, which particular encryption algorithm or procedure is associated with which particular gaming unit (identified by a machine-identification number on the ticket). The barcode reader reads the barcoded machine-identification number from the ticket and then tells the ALU which encryption algorithm was used in determining the validation number imprinted on the ticket.

Electronic processing unit 204 uses the ASCII data derived from the barcode data to automatically compute the validation number, as described above. If electronic processing unit 204 calculates the same validation number as that which is already provided on the ticket, a "PAY" or "GO" message appears at a display 206 of the validation unit; if not, a "DO NOT PAY" or "NO-GO" message appears at the display. (This is conveniently effected by an alphanumeric LED or LCD display, or by red and green lights. In an embodiment described below, the display of a PC is used.) An appropriate "PAY" message advantageously includes the amount to be paid, such as "$123.45," to avoid cashier error. In the event that the validation system determines that the ticket is not genuine, instead of giving the barcoded amount to be paid that is indicated on the ticket, the payout display should provide a "DO NOT PAY" message (such as "00.00" or "- - - ").

In addition to the "DO NOT PAY" message, an unseen visual or audible alarm signal to security personnel (to activate, for example, a light or buzzer) may also be provided to indicate that an apparent counterfeiting situation is occurring. This may conveniently be effected by wire or wireless transmission of an alarm signal from the cashier station to a security station.

Separate Component System

In another embodiment, separate components from different manufacturers are utilized, without combining them into (and marketing) a single stand-alone validation unit. This approach is more convenient (and less expensive) when the cashier's station already includes a personal computer (for example, a 486 PC) for other reasons. However, since this approach calls for using software on a disk and a standard personal computer, it is considered less secure and to that extent less preferable. (As described below, a "black box" connected to a port of the computer may also be used to replace or supplement disk-based software.)

When the ticket is brought to the cashier, the cashier runs a conventional optical wand over the ticket, or uses another conventional barcode reading device for this purpose. The output is fed to a personal computer. If necessary (for barcode readers without any built-in wedge), an interface device is used, such as a card inside the personal computer or a device such as the Barcode Industries, Inc., Beltsville, Md., "MINIBAR" interface device (also known as a barcode keyboard wedge, which "fools" a PC into regarding scanned barcode data as data typed on a computer keyboard). Barcode software keyboard wedges are also available, which permit a barcode scanner to be connected to an RS 232 port of a PC, which then process signals from the barcode scanner. Because a PC cannot distinguish between output from a keyboard wedge and data keypunched to the PC from its keyboard, the present invention is backward-compatible with previous gaming industry practices and equipment.

An additional security feature is made available by not placing the validation software system on hard disk or floppy diskette, and instead placing it (or critical parts of it) in an external unit. One embodiment of this is a "black box" containing an EPROM or using a ROM-containing microcontroller chip with a set security bit, wherein the encryption algorithm is stored. The black box is then connected to the PC via a port of the PC. A further such embodiment places an equivalent card inside the PC in lieu of the black box. Other security expedients include subjecting an unsecured program to a series of XOR steps under the direction of a procedure stored in EPROM, in effect scrambling the lines of the unsecured program.

Audit Facility

The foregoing system, whether the stand-alone or separate component type, will ordinarily result in all necessary auditing data being imprinted on a duplicate ticket retained inside the cabinet. At present, these retained tickets are audited daily by having a person go to each machine and record the data by reading each ticket and entering the information from it. This is a time-consuming task and at times results in errors.

The process can be vastly speeded up and made more accurate by providing for barcoding of all required audit data and then reading the audit data from the retained tickets by passing an optical wand over the barcode data on the retained tickets. To take advantage of this option, all data necessary for auditing purposes should be barcoded, even if it is not needed for ticket validation purposes.

Concluding Remarks Remarks

An improved method and apparatus for validating payout tickets has been described that places a machine-readable indicium on payout tickets, thereby allowing validation to be performed with the method and apparatus of the invention, instead of requiring human, error-prone, laborious, and time-consuming data entry. The validation system of the invention derives a control signal (data signal) from barcoded (or other machine-readable) data on a payout ticket and then compares the control signal with a reference signal (broadly defined) to determine whether the signals have a predetermined relationship and therefore that the payout ticket is genuine (valid).

As has been indicated earlier, it is estimated that manual data entry using a keyboard produces one incorrect character entry for every 300 keystrokes. Barcode data entry, however, is orders of magnitude more error-free. Accordingly, if entry of data from a payout ticket is hypothetically considered to involve 8 validation number keystrokes, 8 ticket serial number keystrokes, 8 date keystrokes (mm/dd/yy), 6 time keystrokes (hh/mm PM), and 6 payout amount keystrokes (_._), for a total of 36 keystrokes, an error will occur in more than 1 out of 10 manual data entry ticket validations. This error rate falls to virtually zero with use of barcoded data entry in accordance with the invention. Further, the system of the invention makes use of validation systems with more input parameters far more feasible, with concomitant greater security against counterfeiting.

It is contemplated that some users may prefer to use the encryption or security schemes that such users already have in place, taking advantage of the use of barcoding and a barcode reader to eliminate human, error-prone, laborious, and time-consuming data entry. The various different security expedients now in common use in the gaming industry are readily adapted to the present invention by persons of skill in electronic equipment design, once they are directed to make the adaptation by using as a template the method and apparatus described above.

While the invention has been described in connection with specific and preferred embodiments thereof, it is capable of further modifications without departing from the spirit and scope of the invention. This application is intended to cover all variations, uses, or adaptations of the invention, following, in general, the principles of the invention and including such departures from the present disclosure as come within known or customary practice within the art to which the invention pertains, or as are obvious to persons skilled in the art, at the time the departure is made. It should be appreciated that the scope of this invention is not limited to the detailed description of the invention hereinabove, which is intended merely to be illustrative, but rather comprehends the subject matter defined by the following claims.

As used in the following claims, the following terminology has the meaning set forth below:

A "payout event" is an event in which a customer of a gaming machine in a casino or similar gaming establishment wins and thereby becomes entitled to be paid a sum of money ("payout amount"). A "purported" payout event is one that may or may not have actually occurred, since a ticket being presented to evidence a purported payout event may actually be a counterfeit; an object of the invention is to distinguish between counterfeit tickets, whose purported payout events are nonexistent, and genuine tickets, which result from an actual payout event that the ticket correctly evidences (in which case the purported payout event actually occurred in accordance with what the ticket purports to evidence). Thus a ticket that purports to represent payout-related-data concerning an actual payout event will contain, among other things, an imprint of a "putative" payout amount; the putative payout amount on the ticket may be genuine or bogus, and the apparatus and method of the invention are directed to determining whether such putative data are genuine or bogus.

Parameters associated with a payout event (payout-event-related parameters) may include, among other things, a time of payout event, a date of payout event, a payout amount, an identification number of the gaming machine involved, a serial number of the payout ticket. References to one or more payout-event-related parameters refer to one or more of the foregoing parameters. (References to one or more other payout-event-related parameters ordinarily refer to a parameters other than payout amount, i.e., to one or more of the following: time of payout event, a date of payout event, an identification number of the gaming machine involved, a serial number of the payout ticket.) Payout-event-related parameters are specific to a particular payout event when, in combination, they uniquely exist for only that particular payout event (for example, a particular time, date, payout amount, gaming unit, etc. when and where some customer hit a jackpot in a video slot gaming machine).

Machine-readable indicia embodied on or in a ticket include, among other things, barcoded symbols imprinted on the ticket and magnetically encoded information coded into a magnetic strip comprising part of a ticket (as in a farecard or credit card). A data signal derived from a machine-readable indicium embodied in or on a payout ticket comprises signals representative of what purport to be various payout-event-related parameters. Thus, a data signal from a payout ticket may contain signals purporting to be representative of a given payout amount (i.e., a putative payout amount), of a given time of ticket issuance (i.e., a putative time of ticket issuance), and other similar data.

As used here, that a signal or indicium is representative of a given datum (for example, a payout amount) means that the data of which the signal or indicium is representative comprises the given datum. That a signal or indicium is representative of a given datum (for example, a payout amount) does not exclude the possibility that the same signal or indicium is also representative of other data (for example, a time of ticket issuance).

A comparator is a hardware device, or computer instructions in a programmed microprocessor or other computer device, for comparing two electronic signals (and therefore for comparing the data of which the two signals are representative).

The subject matter claimed is:

1. A method for issuing and validating a payout ticket for a gaming machine for playing a game that has a payout event that entitles a customer to a payout amount when the customer wins the game, the method comprising:

(1) upon occurrence of a payout event in a gaming machine, automatically determining a validation number and printing payout-event-related imprint data on a payout ticket, the payout-event-related imprint data comprising the validation number and a payout amount, the validation number (V) being a predetermined function (F) of at least one parameter (v) selected from the following group of parameters: the payout amount, a win time representative of a time when the payout event occurred, a win date representative of a date on which the payout event occurred, a machine number representative of identity of the gaming machine, and a ticket number representative of a serial number associated with the ticket, so that V=F (v);

(2) automatically embodying in the payout ticket a machine-readable indicium, the machine-readable indicium being representative of payout-event-related embodiment data, the payout-event-related embodiment data comprising the validation number;

(3) automatically issuing the payout ticket to a customer;

(4) causing the payout ticket to be taken to a cashier station and presented for redemption;

(5) electronically scanning the payout ticket to read the machine-readable indicium thereof, to provide a data signal which is representative of putative embodiment data of which the machine-readable indicium of the payout ticket is representative, said putative embodiment data comprising a putative validation number;

(6) electronically processing the data signal to determine whether the data signal is consistent with the payout ticket's being genuine; and (7) automatically providing a human-intelligible indicium of whether, as a result of the electronically processing the data signal in step (6), it is determined that the data signal is consistent with the payout ticket's being genuine.

2. The method of claim 1 wherein the at least one parameter selected is the payout amount, so that the validation number (V) is a predetermined function (F) of the payout amount (p) such that V=F(p).

3. The method of claim 2 wherein:

(a) the payout-event-related embodiment data of step (2) comprises the payout amount, and the data signal of step (5) is representative of a putative validation number (V') and a putative payout amount (p');

(b) the putative validation number (V') and the putative payout amount (p') have the predetermined functional relationship (F) such that V'=F(p'); and (c) the electronically processing the data signal in step (6) to determine whether the data signal is consistent with the payout ticket's being genuine comprises determining whether the putative validation number (V') of which the data signal is representative and the putative payout amount (p') of which the data signal is representative have the predetermined functional relationship (F) such that F(p')=V'.

4. The method of claim 1 wherein:

(a) the payout-event-related embodiment data of step (2) comprise the payout amount (p) and at least one other payout-event-related parameter (u), whereby the data signal of step (5) is representative of a validation number (V), a payout amount (p), and at least one other payout-event-related parameter (u);

(b) the validation number, the payout amount, and the at least one other payout-event-related parameter of the payout-event-related embodiment data of step (2) have a predetermined functional relationship (F) such that V=F(p,u); and (c) the electronically processing the data signal in step (6) to determine whether the data signal is consistent with the payout ticket's being genuine comprises determining whether a putative validation number (V'), a putative payout amount (p'), and an at least one other putative payout-event-related parameter (u') have the predetermined functional relationship (F) such that F(p',u')=V'.

5. The method of claim 4 wherein:

(a) the validation number (V) included in the payout-event-related data is a predetermined function (F) of the payout amount (p) and the at least one other payout-event-related parameter (u), such that V=F(p,u); and (b) the determining whether the putative validation number (V'), the putative payout amount (p'), and the one or more other putative payout-event-related parameters (u') have the predetermined relationship comprises electronically computing F(p',u') and electronically comparing the value of F so computed with V' to determine whether F(p',u')=V'.

6. The method of claim 1, wherein the machine-readable indicium is barcode data, the machine-readable indicium is embodied on the payout ticket by a barcode printer, and the scanning of the payout ticket and the reading of the machine-readable indicium is performed with a barcode reader.

7. The method of claim 1, wherein:

(a) the machine-readable indicium embodied in the ticket comprises a machine-readable indicium representative of at least one of time and date when the ticket was provided to a customer, whereby the data signal comprises an issue-time signal purportedly representative of when the ticket was provided to a customer; and (b) the electronically processing the data signal in step (6) to determine whether the data signal is consistent with the payout ticket's being genuine comprises the following steps:

(i) reading at least one of current time and current date from an electronic clock to provide a current-time signal representative of when the ticket was presented for payment; and (ii) electronically comparing the current-time signal with the issue-time signal, to provide a signal indicative of whether when the ticket was presented for payment fell within a predetermined window after when the issue-time signal represents that the ticket was provided to the customer.

8. A method according to claim 1, comprising embodying, in a copy of the payout ticket retained in the gaming machine, a machine-readable indicium representative of audit data, where the audit data is such data as is required for audit purposes for the gaming machine.

9. A gaming machine for playing a game that has a payout event that entitles a customer to a payout amount of money when the customer wins the game, the machine comprising:

a printed circuit board for playing the game;

coupled to the printed circuit board a validation-signal processing unit for generating, upon occurrence of a payout event, a validation signal representative of a validation number, the validation number (V) being a predetermined function (F) of at least one parameter (v) selected from the following group of parameters: the payout amount, a win time representative of a time when the payout event occurred, a win date representative of a date on which the payout event occurred, a machine number representative of identity of the gaming machine, and a ticket number representative of a serial number associated with the ticket, so that V=F (v);

coupled to the printed circuit board a ticket-signal processing unit for generating, upon occurrence of a payout event, a ticket signal representative of payout-event-related data, the payout-event-related data comprising the validation number and a payout amount;

coupled to the ticket-signal processing unit a printer for operating in response to the ticket signal, to print on a payout ticket alphanumeric symbols representative of the payout-event-related data;

coupled to the ticket-signal processing unit a selector for cooperating with the ticket-signal processing unit to select a coding signal from the ticket signal, the coding signal being representative of the validation number and at least one parameter selected from the following group of parameters: the payout amount, the win time, the win date, the machine number, and the ticket number; and coupled to the selector, an encoder for operating in response to the coding signal, to embody in the payout ticket a machine-readable indicium representative of the coding signal, whereby the machine-readable indicium is representative of the data of which the coding signal is representative.

10. A gaming machine according to claim 9, wherein the validation number (V) is a predetermined function (F) of at least two of said group of parameters, one of the at least two parameters being the payout amount (p) and another parameter (u) of the at least two parameters being selected from the group consisting of the win time, the win date, the machine number, and the ticket number, so that V=F(p,u).

11. A gaming machine according to claim 9, wherein the encoder is a barcode printer and wherein the machine-readable indicium is barcode data printed on the ticket.

12. A validation apparatus for enhancing security in redemption of a payout ticket for a gaming machine for playing a game that has a payout event that entitles a customer to a payout amount of money when the customer wins the game and presents a payout ticket that bears a validation number (V) that is a predetermined function (F) of at least one parameter (v) selected from the group of payout-event-related parameters consisting of: the payout amount, a win time representative of a time when the payout event occurred, a win date representative of a date on which the payout event occurred, a machine number representative of identity of the gaming machine, and a ticket number representative of a serial number associated with the ticket, so that V=F(v), the payout ticket having a machine-readable indicium representative of a putative validation number (V'), and putative payout-event-related data (v) comprising at least one putative payout-event-related parameter selected from the group consisting of the payout amount, the win time, the win date, the machine number, and the ticket number, the validation apparatus comprising:

a ticket reader for automatically reading the machine-readable indicium of the payout ticket, to provide a data signal which is representative of the putative validation number (V') and the putative payout-event-related data (v') of the machine-readable indicium; and coupled to the ticket reader an electronic processing unit for processing the data signal to determine whether the data signal is consistent with the payout ticket's being genuine, said processing comprising making a determination whether F(v')=V'.

13. A validation apparatus according to claim 12, for processing a payout ticket wherein the payout-event-related data further comprises a putative payout amount (p'), whereby the ticket reader provides the electronic processing unit with a data signal that is representative of the putative validation number (V') and the putative payout amount;

the validation number and the payout amount having a predetermined functional relationship (F) if the ticket is genuine; and the electronic processing unit being adapted to determine whether the putative validation number of which the data signal is representative and the putative payout amount of which the data signal is representative have the predetermined functional relationship (F), so that V'=F(p'), and adapted to provide a signal representative of such determination.

14. A validation apparatus according to claim 12, for processing a payout ticket wherein the valid validation number (V) has a predetermined functional relationship (F) with the payout amount (p) and with at least one parameter (u) selected from the following group of parameters: the payout amount, a win time representative of a time when the payout event occurred, a win date representative of a date on which the payout event occurred, a machine number representative of identity of the gaming machine, and a ticket number representative of a serial number associated with the ticket, such that for a genuine ticket V=F(p,u);

the payout ticket having a machine-readable indicium the putative payout-event-related data of which comprises a putative payout amount (p') and at least one other putative payout-event-related parameter (u'), whereby the ticket reader provides the electronic processing unit with a data signal that is representative of the putative validation number (V'), a putative payout amount (p'), and at least one other putative payout-event-related parameter (u');

the electronic processing unit being adapted to determine whether the putative validation number (V'), the putative payout amount (p'), and the at least one other putative payout-event-related parameter (u') have the predetermined functional relationship such that V'=F(p',u') and adapted to provide a signal representative of such determination.

15. The apparatus of claim 12, wherein the machine-readable indicium is barcode data printed on the ticket and the ticket reader is a barcode reader.

16. The apparatus of claim 12, further comprising:

an electronic clock to provide a current time-signal representative of a time and date when the ticket is being presented for redemption; and as part of the second electronic processing unit:

a signal generator for generating an issue time-signal based on a machine-readable indicium embodied in the ticket, the issue time-signal purporting to be representative of a time and date when the ticket was provided to the customer; and a time comparator for reading the current time-signal from the electronic clock; for comparing the current time-signal with the issue time-signal, to provide a window-test signal; for determining whether the window-test signal has a control value such that time and date read from the electronic clock fall within a predetermined window after a time and date when the issue time-signal purports to represent that the ticket was provided to the customer; and for providing a signal representative of whether the window-test signal has the control value.

17. The apparatus of claim 12, further comprising:

a memory unit in which is stored a record of history data, the history data comprising, for payout tickets previously redeemed during a predetermined historical interval, payout ticket data specific to the previously redeemed payout tickets; and as part of the second electronic processing unit, a history comparator:

for comparing with the record of history data a test signal derived from the data signal, the test signal being representative of ticket data purportedly specific to the ticket being presented for redemption; and for providing a signal representative of whether the ticket data purportedly specific to the ticket being presented for redemption is the same as history data in the memory unit.

18. An electronically readable and verifiable payout ticket encoded with a machine-readable indicium, the machine-readable indicium being representative of payout-event-related embodiment data, the payout-event-related embodiment data comprising a validation number, the validation number (V) being a predetermined function (F) of at least one parameter (v) selected from a group of parameters consisting of: the payout amount, a win time representative of a time when the payout event occurred, a win date representative of a date on which the payout event occurred, a machine number representative of identity of the gaming machine, and a ticket number representative of a serial number associated with the ticket, so that V=F(v), whereby the validation number (V) and the at least one parameter (v) are machine readable from the ticket.

19. A payout ticket according to claim 18 wherein the validation number (V) is a predetermined function (F) of the payout amount (p) such that V=F(p) and wherein the validation number (V) and the payout amount (p) are machine readable from the ticket.

20. A payout ticket according to claim 18 wherein:

the validation number (V) is a predetermined function (F) of at least two parameters of said group of parameters;

one parameter of the at least two parameters being the payout amount (p);

another parameter (u) of the at least two parameters being selected from the group consisting of the win time, the win date, the machine number, and the ticket number, so that V=F(p,u); and V, p, and u are machine readable from the ticket.

* * * * *